United States Patent [19]

Pease

[11] 4,037,314

[45] * July 26, 1977

[54] METHOD OF PRODUCING AN ELECTRICAL HEATING ELEMENT AND FITTING ASSEMBLY

[76] Inventor: James F. Pease, 5805 Folkestone Drive, Dayton, Ohio 45459

[ * ] Notice: The portion of the term of this patent subsequent to May 8, 1990, has been disclaimed.

[21] Appl. No.: 640,737

[22] Filed: Dec. 15, 1975

Related U.S. Application Data

[60] Division of Ser. No. 454,291, March 25, 1974, Pat. No. 3,930,140, which is a continuation-in-part of Ser. No. 334,002, Feb. 20, 1973, Pat. No. 3,800,415, which is a division of Ser. No. 244,516, April 17, 1972, Pat. No. 3,732,398, which is a continuation-in-part of Ser. No. 194,742, Nov. 1, 1971, abandoned.

[51] Int. Cl.[2] ..... H05B 3/04

[52] U.S. Cl. ..... 29/611; 156/294; 156/305

[58] Field of Search ..... 29/611, 610; 156/294, 156/305; 339/130, 132; 219/316, 318, 335, 537, 463, 336, 536, 523, 542; 338/240, 272, 326, 317, 238; 174/77 R, 75 R, 76, 65

[56] References Cited

U.S. PATENT DOCUMENTS

| | | | |
|---|---|---|---|
| 2,245,602 | 6/1941 | Morris | 338/240 X |
| 2,630,469 | 3/1953 | Miller | 339/130 R X |
| 3,118,124 | 1/1964 | Bleckmann | 338/317 |
| 3,354,294 | 11/1967 | Kollar et al. | 219/536 |
| 3,676,254 | 7/1972 | Hight et al. | 156/294 X |
| R13,095 | 3/1910 | Ruby | 339/130 R |

*Primary Examiner*—Victor A. DiPalma
*Attorney, Agent, or Firm*—Jacox & Meckstroth

[57] ABSTRACT

A heating element includes an elongated tubular sheath which confines a resistance wire supported by a thermally conductive electrical insulation material which extends to a position flush with the end surface of the sheath. Each end portion of the heating element is supported by a bulkhead fitting which is formed of a sheet metal and includes a tubular wall portion having helical convolutions defining external threads. A radial flange portion projects outwardly from the tubular wall portion and forms an annular tapered hub portion firmly engaging the outer surface of the sheath. The flush end surfaces of the insulation material and the sheath are spaced inwardly from the end surface of the fitting to define a cavity, and a thermosetting sealant material is disposed within this cavity and the space defined between the outer surface of the sheath and the helical convolutions.

6 Claims, 4 Drawing Figures

METHOD OF PRODUCING AN ELECTRICAL HEATING ELEMENT AND FITTING ASSEMBLY

RELATED APPLICATIONS

This application is a division of application Ser. No. 454,291, filed Mar. 25, 1974, issued as U.S. Pat. No. 3,930,140 which is a continuation-in-part of application Ser. No. 334,002, filed Feb. 20, 1973, issued as U.S. Pat. No. 3,800,415, which is a division of Ser. No. 244,516, filed Apr. 17, 1972, issued as U.S. Pat. No. 3,732,398, which is a continuation-in-part of application Ser. No. 194,742, filed Nov. 1, 1971, abandoned.

BACKGROUND OF THE INVENTION

The present invention is directed to an improvement in the method of producing an electrical heating element and fitting assembly of the type disclosed in U.S. Pat. No. 3,657,519 which issued on Apr. 18, 1972 on an application copending with above parent application Ser. No. 194,742.

In the art of electrical heating elements which are used within the sump of either a commercial or a domestic dishwashing machine, commonly the heating element includes an elongated tubular metal sheath in which a nickel-chromium electrical resistance wire is concentrically supported by a thermally conductive electrical insulation material such as magnesium oxide. The ends of the wire are attached to corresponding terminal pins which project axially from the end portions of the sheath. A machined metal fitting is commonly brazed or soldered to the end portions of the sheath.

To protect the dry rigid magnesium oxide insulation material and hermetically seal it against moisture, the material is sandblasted or mechanically removed from each end or tip portion of the sheath to define an annular cavity surrounding the projecting terminal pin. This cavity is then filled with a sealant material such as an epoxy resin, for example, as illustrated in U.S. Pat. No. 3,354,294. These sandblasting and filling operations require substantial time and add significantly to the cost of producing the heating element.

The above patent application discloses a novel and an improved means for securing the end portions of a sheath-type heating element to the wall of a liquid heating tank or vessel. This means includes a tubular bulkhead bushing or fitting which is drawn from sheet metal such as brass and is deformed to define helical convolutions which form external threads for receiving a mating drawn sheet metal nut. The bulkhead fitting is secured and sealed to the corresponding end portion of the sheath by soft solder which forms an electrical ground connection between the end portion of the sheath and the fitting so that the sheath can be grounded through the fitting by a suitable ground wire attached to the fitting through a ring-type terminal.

SUMMARY OF THE INVENTION

The present invention is directed to an improved electrical heating element and bulkhead fitting assembly which significantly reduces the cost of manufacturing the assembly by eliminating operations for preparing the heating element to receive the fittings and by simplifying the assembly of the fittings onto the heating element and hermetically sealing the heating element all in one assembly operation. That is, the present invention eliminates the need for sandblasting the thermally conductive insulation material from each end portion of the sheath of the heating element and provides for hermetically sealing the insulation material within the heating element during the operation of assembling the fitting onto the heating element. The invention also provides a simplified means for forming a positive electrical ground between the bulkhead fitting and the end portion of the sheath without soldering the fitting to the sheath. Thus, the invention eliminates the need for washing the fitting after the soldering operation to remove the soldering flux, and further provides for minimizing the gauge of the sheet metal which is used for producing the fitting. In addition, the invention provides for mounting each fitting onto the sheath with a fluid cement and in a manner which provides for immediate handling of a heating element and fitting assembly before the cement cures.

The above features and advantages and other advantages of the invention will be clearly apparent from the following description, the accompanying drawing and the appended claims.

DESCRIPTION OF THE PREFERRED EMBODIMENTS

Figure 1:
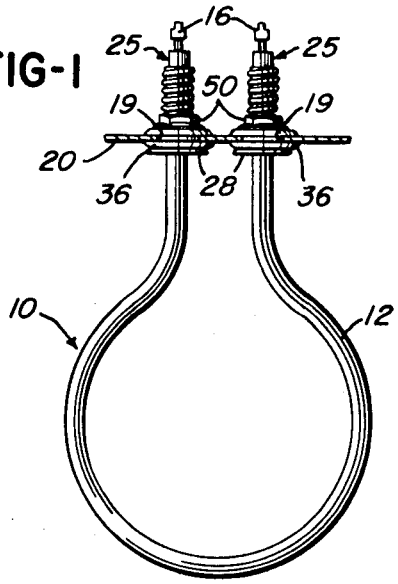
FIG. 1 is a plan view of a heating element and fitting assembly constructed in accordance with the invention and shown mounted on the wall of a liquid heating vessel.

The immersion heating element 10 shown in FIG. 1 is illustrative of the type commonly mounted within the sump of an automatic dishwashing machine for heating water and for also heating air during the drying period of the washing cycle. The heating element 10 includes a metallic sheath 12 which is usually formed from stainless steel or nickel alloy tubing and has a circular cross-sectional configuration. While the sheath 12 shown in FIG. 1 is generally circular, the sheath may be formed in practically any configuration such as, for example, rectangular with rounded corners or serpentine shaped.

The sheath 12 encloses a high resistance conductor or wire 13 having ends connected to corresponding low resistance terminal pins 14 which extend concentrically through the end portions 15 of the heating element to terminal connectors 16. A thermally conductive electrical insulation 18 such as magnesium oxide, surrounds the wire 13 and each terminal pin 14 and supports the wire and pins concentrically within the sheath 12.

As shown in the above application, each end portion 15 of the heating element 10 extends through a corresponding circular hole or opening 19 (FIG.1) formed within a bulkhead or wall 20 such as the wall which defines the sump of an automatic dishwashing machine. Each end portion 15 of the heating element 10 is secured to the wall 20 by a fitting assembly which includes a tubular bulkhead fitting 25 (FIG.2) formed by drawing and deforming a sheet metal disk in successive or progressive steps. Since the fittings 25 mounted on both end portions 15 of the heating element 10 are identical, only one will be described in detail.

In accordance with the present invention, each fitting 25 includes a flange portion 28 which is partially formed by an outwardly projecting radial flange wall 29. The wall 29 has an outer periphery integrally connected to an inwardly projecting radial flange wall 31 which extends to form a frustoconical annular wall or hub portion 32 defining a circular opening having a diameter slightly less than the outer diameter of the sheath 12.

Figure 2:
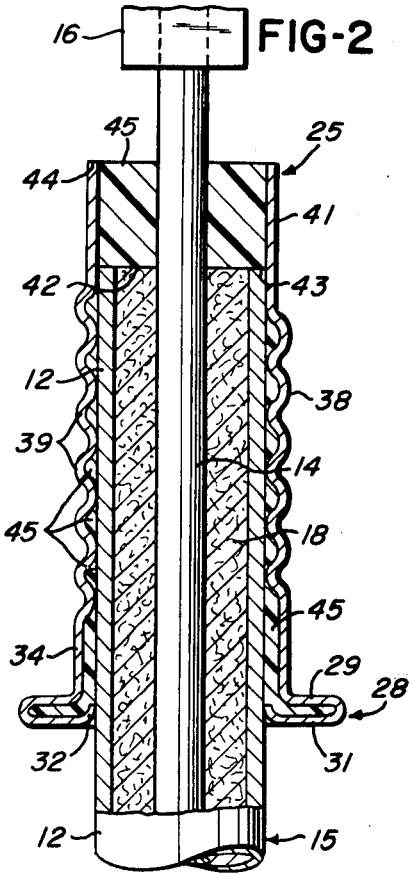
FIG. 2 is an enlarged fragmentary axial section of a heating element and fitting assembly.

The fitting 25 further includes a cylindrical wall portion 34 which extends from the flange wall 29 and which is adapted to receive a rubber grommet 36 (FIG.1) mounted within the corresponding opening 19 within the wall 20 when the heating element is installed within the wall. The cylindrical wall portion 34 connects with a tubular wall portion 38 having helical convolutions 39 which define corresponding external helical treads. As a result of the uniform wall thickness of the fitting 25, the convolutions 39 provide the tubular portion 38 with a corrugated wall configuration in axial cross-section as illustrated in FIG. 2. Preferably the inner diameter of the convolutions 39 is substantially the same as the outer diameter of the sheath 12 as shown in FIG. 2. The convoluted tubular portion 38 connects with a cylindrical or annular wall portion 41 which preferably also has an inner diameter substantially the same as the outer diameter of the sheath 12.

As shown in FIG. 2, the end surface 42 of the insulation material 18 is flush with the end surface 43 of the sheath 12, and these flush end surfaces are located inwardly from the outer end surface 44 of the fitting 25. A water-tight seal is formed between the end portion of the sheath 12 and the bulkhead fitting 25 by a sealant material 45. Preferably, the sealant material 45 consists of a heat activated thermosetting epoxy resin. This material fills not only the annular space or cavity around the terminal pin 14 between the end surface of the fitting 25 and the flush end surfaces of the sheath 12 and insulation material 18, but also fills the space defined between each convolution 39 and the outer surface of the sheath 12. The sealant material 45 also fills the space between the parallel walls 29 and 31 of the flange portion 28 as well as the space defined between the cylindrical wall portion 34 and the outer surface of the sheath 12.

Figure 3:
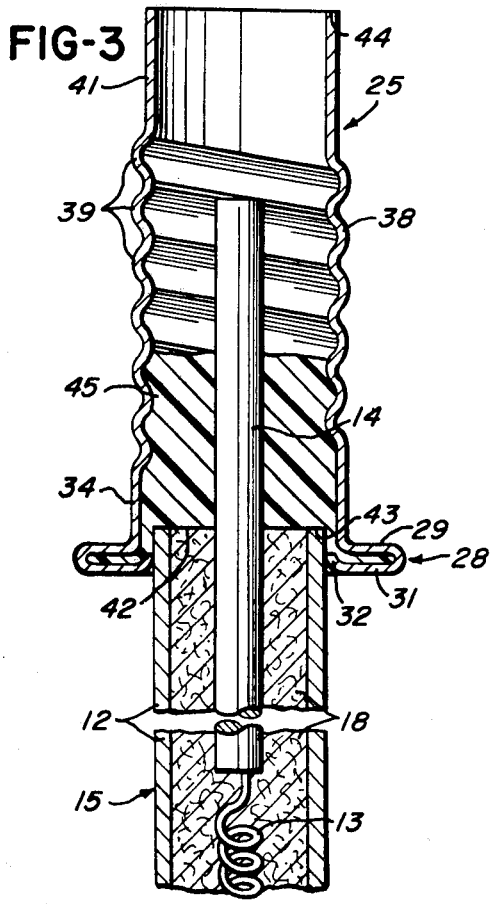
FIG. 3 is an enlarged axial section similar to FIG. 2 and illustrating the method of assembling a fitting onto an end portion of the heating element.

Referring to FIG. 3, each of the bulkhead bushings or fittings 25 is assembled onto the corresponding end portion 15 of the heating element 10 in the following manner. The hub portion 32 of the fitting 25 is pressed onto the end portion of the sheath 12 until the sheath projects a fraction of an inch into the fitting as indicated in FIG. 3. A predetermined quantity of heat activated liquid epoxy resin material 45 is injected or poured into the fitting 25 so that the material 45 fills the space within the flange portion 28 of the fitting and the space above the flush end surfaces of the sheath 12 and insulation material 18 to a level as generally indicated in FIG. 3. The fitting 25 is then pressed further onto the end portion 15 of the heating element 12 until the fitting 25 is positioned as shown in FIG. 2.

During this pressing operation, the epoxy resin material 45 fills the space between the convolutions 39 and the outer surface of the sheath 12 and results in filling the annular space or cavity surrounding the terminal pin 16 between the end surface of the fitting 25 and the flush end surfaces of the sheath 12 and insulation material 18. The heating element assembly is then heated within an oven to activate the epoxy resin material 45 and to set the material to a rigid condition forming a positive hermetic seal between the fitting 25 and the corresponding end portion 15 of the heating element 10. When the heating element is installed within the tank wall 20, the rubber grommets 36 form water-tight seals between the flange portions 28 of the fittings 25 and the tank wall 20 in response to tightening of mating tubular sheet metal nuts 50 threaded onto the tubular portions 38 of the fittings as shown in the above application.

Figure 4:
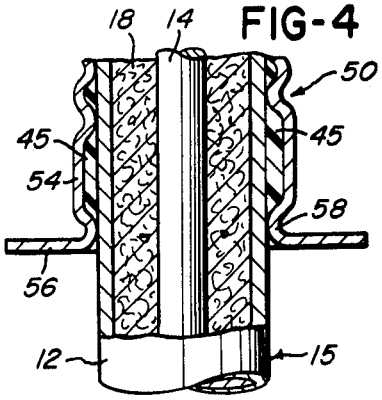
FIG. 4 is an enlarged fragmentary section showing another embodiment of the invention.

Referring to FIG. 4, a modified form of a heating element and fitting assembly includes a tubular fitting 50 having a cylindrical wall portion 54 which corresponds with the cylindrical wall portion 34 of the fitting 25 shown in FIG. 2 and is adapted to receive the rubber grommet 36. An outwardly projecting radial flange portion 56 is connected to the cylindrical wall portion 54 by a curved neck or annular wall or hub portion 58 which projects inwardly from the cylindrical wall portion 54 and firmly engages the outer surface of the metallic sheath 12. Thus the neck or hub portion 58 serves the same function as the hub portion 32 of the embodiment shown in FIGS. 2 and 3, that is, to confine the sealant material 45 and to provide a tapered or curved lead surface for inserting the sheath 12 into the fitting 50. In other respects, the fitting 50 is constructed substantially identical to the fitting 25.

From the drawing and the above description, it is apparent that a heating element and fitting assembly constructed in accordance with the present invention, provides desirable features and advantages. For example, the bulkhead bushing or fitting 25 or 50 is quickly and economically produced from a disc of sheet metal and assembles onto an end portion 15 of a heating element 10 in a manner which eliminates the operation of sandblasting an annular cavity within the end portion of the metal sheath 12 around the terminal pin 14. The epoxy resin material not only forms a positive hermetic seal for the end surface of the insulation material 18, but also forms a water-tight seal between the fitting 25 or 50 and the outer surface of the sheath 12. In addition, the rigid epoxy resin forms a rigid solid mass between the convolutions 39 and the end portion 15 of the heating element 10 so that the threads formed by the convolutions 39 do not collapse or deform when the corresponding nut 50 is tightened with substantial torque. The epoxy sealant material is also confined or trapped between the axially spaced hub portions 32 or 58 and the cylindrical portion 41, thereby assuring that the material does not flow out of this space while the material is hardening.

The hub portion 32 of the fitting 25 or the hub portion 58 of the fitting 50 not only forms a tapered lead surface receiving the tip portion of the heating element 10 in a press-fit relation, but also forms a positive electrical ground connection between the outer surface of the sheath 12 and the fitting 25 or 50. Furthermore, the double walled flange portion 28 cooperates with the hardened epoxy resin material 45 to provide for minimizing the guage or thickness of the sheet material used for producing the fitting 25.

While the methods and forms of heating element and fitting assembly herein described constitute preferred embodiments of the invention, it is to be understood that the invention is not limited to these precise methods and forms of assembly, and that changes may be made therein without departing from the scope and spirit of the invention.

I claim:

1. In a method of producing an electrical heating element assembly for mounting within spaced openings of a liquid heating vessel, and including the steps of forming an elongated tubular sheath having opposite end portions, positioning an elongated electrical resistance element within the sheath with a thermally conductive insulation material, and extending terminal members from the end portions of the resistance element through corresponding end portions of the sheath, the improvement comprising the steps of drawing a sheet of metal to form a pair of tubular fittings each having a flange portion and a tubular wall portion, deforming said tubular wall portion of each said fitting to produce a helical convoluted thread portion having a corrugated wall configuration in axial cross-section, deforming each said fitting to produce axially spaced first and second annular wall portions, positioning each said fitting on the corresponding said end portion of said tubular sheath with said first and second annular wall portions engaging said sheath at axially spaced locations on said sheath, and confining a fluid bonding and sealant material within the space defined between said tubular wall portion of each said fitting and said sheath and between said axially spaced first and second corresponding annular wall portions.

2. A method as defined in claim 1 wherein the step of deforming each said fitting to form said first annular wall portion, comprises forming an inwardly projecting annular hub portion adjacent said flange portion, and pressing said hub portion of each said fitting axially onto the corresponding said end portion of said sheath.

3. A method as defined in claim 1 wherein said second annular wall portion is formed with a generally cylindrical configuration having an inner diameter substantially the same as the outer diameter of said sheath.

4. In a method of producing an electrical heating element assembly for mounting within spaced openings of a liquid heating vessel, and including the steps of forming an elongated tubular sheath having opposite end portions, positioning an elongated electrical resistance element within the sheath with a thermally conductive insulation material, and extending terminal members from the end portions of the resistance element through corresponding end portions of the sheath, the improvement comprising the steps of drawing a sheet of metal to form a pair of tubular fittings each having a flange portion and a tubular wall portion, deforming said tubular wall portion of each said fitting to produce a helical convoluted thread portion having a corrugated wall configuration in axial cross-section, deforming each said fitting to produce axially spaced first and second annular wall portions with said thread portion therebetween, positioning each said fitting on the corresponding said end portion of said tubular sheath with said first annular wall portion engaging said sheath at axially spaced locations on said sheath, inserting a fluid bonding and sealant material into the space defined between said tubular wall portion of each said fitting and said sheath, and then moving each said fitting axially further onto said sheath until said second annular wall portion engages said sheath for confining the material between said fitting and said sheath and between said axially spaced first and second annular wall portions.

5. A method as defined in claim 4 wherein the step of deforming each said fitting to form said first annular wall portion, comprises forming an inwardly projecting annular hub portion adjacent said flange portion, and pressing said hub portion of each said fitting axially onto the corresponding said end portion of said sheath.

6. A method of producing an electrical heating element assembly for mounting within a liquid heating vessel, comprising the steps of positioning an elongated electrical resistance element within an elongated tubular sheath with a thermally conductive insulation material, drawing a sheet of metal to form a tubular fitting having a flange portion and a tubular wall portion, deforming said tubular wall portion of said fitting to produce a helical convoluted thread portion having a corrugated wall configuration in axial cross-section, deforming said tubular fitting to produce axially spaced first and second annular wall portions, positioning said fitting on the said tubular sheath with said first and second annular wall portions engaging said sheath at axially spaced locations on said sheath, and confining a fluid bonding and sealant material within the space defined between said tubular wall portion of said fitting and said sheath and between said axially spaced first and second annular wall portions.

* * * * *